US011282457B2

(12) United States Patent
Xu

(10) Patent No.: US 11,282,457 B2
(45) Date of Patent: Mar. 22, 2022

(54) PIXEL DRIVING CIRCUIT, DRIVING METHOD THEREOF, AND DISPLAY APPARATUS

(71) Applicants: CHENGDU BOE OPTOELECTRONICS TECHNOLOGY CO., LTD., Sichuan (CN); BOE TECHNOLOGY GROUP CO., LTD., Beijing (CN)

(72) Inventor: Yingsong Xu, Beijing (CN)

(73) Assignees: CHENGDU BOE OPTOELECTRONICS TECHNOLOGY CO., LTD., Sichuan (CN); BOE TECHNOLOGY GROUP CO., LTD., Beijing (CN)

( * ) Notice: Subject to any disclaimer, the term of this patent is extended or adjusted under 35 U.S.C. 154(b) by 588 days.

(21) Appl. No.: 16/316,036

(22) PCT Filed: Jun. 6, 2018

(86) PCT No.: PCT/CN2018/090111
§ 371 (c)(1),
(2) Date: Jan. 7, 2019

(87) PCT Pub. No.: WO2019/109615
PCT Pub. Date: Jun. 13, 2019

(65) Prior Publication Data

US 2021/0272518 A1 Sep. 2, 2021

(30) Foreign Application Priority Data

Dec. 8, 2017 (CN) ..... 201711295429.8

(51) Int. Cl.
*G09G 3/3258* (2016.01)
*G09G 3/3266* (2016.01)
*G09G 3/3291* (2016.01)

(52) U.S. Cl.
CPC ..... *G09G 3/3258* (2013.01); *G09G 3/3266* (2013.01); *G09G 3/3291* (2013.01);
(Continued)

(58) Field of Classification Search
CPC .. G09G 3/3258; G09G 3/3291; G09G 3/3266; G09G 2300/0426; G09G 2300/0626; G09G 2300/0233
See application file for complete search history.

(56) References Cited

U.S. PATENT DOCUMENTS 9,761,173 B2 9/2017 Han et al.
10,032,413 B2 7/2018 Kim et al.
(Continued)

OTHER PUBLICATIONS

1st Office Action dated Apr. 28, 2019 in 201711295429.8.
International Search Report and Written Opinion dated Aug. 29, 2018 in PCT/CN2018/090111.

*Primary Examiner* — David Tung
(74) *Attorney, Agent, or Firm* — Syncoda LLC; Feng Ma

(57) ABSTRACT

A pixel driving circuit is disclosed. A first electrode, a second electrode, and a third electrode of a driving sub-circuit respectively receives a first voltage signal, is coupled to the light-emission control sub-circuit, and to a first electrode of a second storage sub-circuit. A first electrode and second electrode of a first storage sub-circuit is coupled to a first node and receives a second voltage signal respectively. A second electrode of the second storage sub-circuit is coupled to a second node. A writing-compensation control sub-circuit is coupled to the first node and the second node, and receives a data signal, a gate signal, and a third voltage signal. A light-emission control sub-circuit is coupled to the first node, the second node, a second electrode of the driving sub-circuit, and the light-emission sub-circuit, and receives a light-emission control signal.

19 Claims, 8 Drawing Sheets

(52) U.S. Cl.
CPC ..... *G09G 2300/0426* (2013.01); *G09G 2320/0233* (2013.01); *G09G 2320/0626* (2013.01)

(56) References Cited

U.S. PATENT DOCUMENTS

| | | | | |
|---|---|---|---|---|
| 2010/0013816 | A1* | 1/2010 | Kwak | G09G 3/3233 345/211 |
| 2013/0194248 | A1* | 8/2013 | Kim | G09G 3/3233 345/212 |
| 2014/0307010 | A1* | 10/2014 | Han | G09G 3/003 345/691 |
| 2014/0320473 | A1 | 10/2014 | Ma | |
| 2017/0193908 | A1 | 7/2017 | Wang | |

* cited by examiner

PIXEL DRIVING CIRCUIT, DRIVING METHOD THEREOF, AND DISPLAY APPARATUS

CROSS-REFERENCE TO RELATED APPLICATION

The present application claims priority to Chinese Patent Application No. CN 201711295429.8 filed on Dec. 8, 2017, the disclosures of which is hereby incorporated by reference in its entirety.

TECHNICAL FIELD

The present disclosure relates generally to the field of display technologies, and more specifically to a pixel driving circuit, its driving method, and a display apparatus containing the pixel driving circuit.

BACKGROUND

With the rapid development of technologies, there have emerged increasingly more types of display technologies, including traditional liquid crystal display (LCD) technologies, and organic light-emitting diode (OLED) display technologies, etc.

Currently, the OLED-based display technologies include active-matrix organic light-emitting diode (AMOLED) display technologies, and electrophoresis display technologies, and so on. Compared with other types of display panels, an OLED display panel has advantages including a self-luminescent display, a fast response, a high brightness, and a wide angle of view, etc., and therefore the organic electroluminescent diode display technologies have a wide application prospect.

Despite the above mentioned advantages, most current OLED display panels employ transistors as switches. Transistors are typically formed from low-temperature polysilicon produced by excimer laser annealing and/or ion implantation. During the manufacturing process of the transistors, there exist certain differences between different transistors. Such a lack of uniformity causes voltage deviations between these different transistors, resulting in an uneven brightness among different pixels, and in turn leading to the appearance of alternate light and shade in the display panel.

SUMMARY

In order to address the above mentioned issues associated with existing display technologies, the present disclosure provides a pixel driving circuit, its driving method, and a display apparatus containing the pixel driving circuit.

In a first aspect, a pixel driving circuit is disclosed.

The pixel driving circuit includes a writing-compensation control sub-circuit, a light-emission control sub-circuit, a first storage sub-circuit, a second storage sub-circuit, a driving sub-circuit, and a light-emission sub-circuit.

A first electrode of the driving sub-circuit is configured to receive a first voltage signal; a second electrode of the driving sub-circuit is electrically coupled to the light-emission control sub-circuit; and a third electrode of the driving sub-circuit is electrically coupled to a first electrode of the second storage sub-circuit.

A first electrode of the first storage sub-circuit is electrically coupled to a first node; and a second electrode of the first storage sub-circuit is configured to receive a second voltage signal. A second electrode of the second storage sub-circuit is electrically coupled to a second node.

The writing-compensation control sub-circuit is electrically coupled to the first node and the second node, and the writing-compensation control sub-circuit is configured to receive a data signal, a gate signal, and a third voltage signal, and is configured, under control of the gate signal, to control whether the first node receives the data signal, whether the second node receives the third voltage signal, and whether the third electrode of the driving sub-circuit is electrically connected with the second electrode of the driving sub-circuit.

The light-emission control sub-circuit is electrically coupled to the first node, the second node, a second electrode of the driving sub-circuit, and the light-emission sub-circuit, and the light-emission control sub-circuit is configured to receive a light-emission control signal, and is further configured, under control of the light-emission control signal, to control whether the first node is electrically connected with the second node, and whether the second electrode of the driving sub-circuit is electrically connected with the light-emission sub-circuit.

According to some embodiments of the pixel driving circuit, the driving sub-circuit comprises a P-type driving transistor, and a source electrode, a drain electrode, and a gate electrode of the driving transistor are respectively the first electrode, the second electrode, and the third electrode of the driving sub-circuit.

According to some embodiments of the pixel driving circuit, the writing-compensation control sub-circuit comprises a first transistor, a second transistor, and a third transistor.

With regard to the first transistor, a source electrode thereof is configured to receive the data signal, a drain electrode thereof is electrically coupled to the first node, and a gate electrode thereof is configured to receive the gate signal.

With regard to the second transistor, a source electrode thereof is configured to receive the third voltage signal, a drain electrode thereof is electrically coupled to the second node, and a gate electrode thereof is configured to receive the gate signal.

With regard to the third transistor, a source electrode thereof is electrically coupled to the second electrode of driving sub-circuit, a drain electrode thereof is electrically coupled to the third electrode of the driving sub-circuit, and a gate electrode thereof is configured to receive the gate signal.

According to some embodiments of the pixel driving circuit, the light-emission control sub-circuit comprises a fourth transistor and a fifth transistor.

With regard to the fourth transistor, a source electrode thereof is electrically coupled to the first node, a drain electrode thereof is electrically coupled to the second node, and a gate electrode thereof is configured to receive the light-emission control signal.

With regard to the fifth transistor, a source electrode thereof is electrically coupled to the second electrode of the driving sub-circuit, a drain electrode thereof is electrically coupled to the light-emission sub-circuit, and a gate electrode thereof is configured to receive the light-emission control signal.

According to some embodiments of the pixel driving circuit, the first storage sub-circuit comprises a first storage capacitor, wherein a first electrode thereof is electrically coupled to the first node, and a second electrode thereof is configured to receive the second voltage signal.

According to some embodiments of the pixel driving circuit, the second storage sub-circuit comprises a second storage capacitor, wherein a first electrode thereof is electrically coupled to the third electrode of the driving sub-circuit, and a second electrode thereof is electrically coupled to the second node.

According to some embodiments, the pixel driving circuit further comprises a first initiating sub-circuit, wherein the first initiating sub-circuit is electrically coupled with the light-emission sub-circuit, and is configured to receive a first initiating signal and a first initiating control signal, and the first initiating sub-circuit is configured, under control of the first initiating control signal, to control whether the light-emission sub-circuit receives the first initiating signal.

Herein, the first initiating sub-circuit can include a first initiating transistor. A source electrode thereof is configured to receive the first initiating signal, a drain electrode thereof is electrically coupled to the light-emission sub-circuit, and a gate electrode thereof is configured to receive the first initiating control signal.

According to some embodiments, the pixel driving circuit further comprises a second initiating sub-circuit, wherein the second initiating sub-circuit is electrically coupled with the first node, and is configured to receive a second initiating signal and a second initiating control signal, and the second initiating sub-circuit is configured, under control of the second initiating control signal, to control whether the first node receives the second initiating signal.

Herein, the second initiating sub-circuit can include a second initiating transistor. A source electrode thereof is configured to receive the second initiating signal, a drain electrode thereof is electrically coupled to the first node, and a gate electrode thereof is configured to receive the second initiating control signal.

According to some embodiments of the pixel driving circuit, the first voltage signal and the second voltage signal are same. Furthermore, in these embodiments of the pixel driving circuit, the first voltage signal and the third voltage signal can also be same or can be different.

In a second aspect, the present disclosure further provides a method for driving a pixel driving circuit.

The method comprises at least one display cycle, and each of the at least one display cycle comprises a writing-compensation control stage and a light-emission control stage.

The writing-compensation control stage comprises: manipulating a light-emission control signal and a gate signal, such that a first node is electrically disconnected from a second node, and a second electrode of a driving sub-circuit is electrically disconnected from a light-emission sub-circuit; and that a data signal is written to a first storage sub-circuit, the second node receives a third voltage signal; and the second electrode of the driving sub-circuit is electrically coupled with a third electrode of the driving sub-circuit.

The light-emission control stage comprises: manipulating the light-emission control signal and the gate signal, such that the first node does not receive the data signal, the second node does not receive the third voltage signal, and the second electrode of the driving sub-circuit is electrically disconnected with the third electrode of the driving sub-circuit; and that the first node is electrically connected with the second node, and the second electrode of the driving sub-circuit is electrically connected with a light-emission sub-circuit to thereby allow the light-emission sub-circuit to emit lights.

According to some embodiments of the method, the driving sub-circuit comprises a P-type driving transistor, and a source electrode, a drain electrode, and a gate electrode of the driving transistor are respectively the first electrode, the second electrode, and the third electrode of the driving sub-circuit. The pixel driving circuit further comprises a first transistor, a second transistor, a third transistor, a fourth transistor, and a fifth transistor.

Herein, with regard to the first transistor, a source electrode thereof is configured to receive the data signal, a drain electrode thereof is electrically coupled to the first node, and a gate electrode thereof is configured to receive the gate signal. With regard to the second transistor, a source electrode thereof is configured to receive the third voltage signal, a drain electrode thereof is electrically coupled to the second node, and a gate electrode thereof is configured to receive the gate signal. With regard to the third transistor, a source electrode thereof is electrically coupled to the second electrode of the driving sub-circuit, a drain electrode thereof is electrically coupled to the third electrode of the driving sub-circuit, and a gate electrode thereof is configured to receive the gate signal. With regard to the fourth transistor, a source electrode thereof is electrically coupled to the first node, a drain electrode thereof is electrically coupled to the second node, and a gate electrode thereof is configured to receive the light-emission control signal. With regard to the fifth transistor, a source electrode thereof is electrically coupled to the second electrode of the driving sub-circuit, a drain electrode thereof is electrically coupled to the light-emission sub-circuit, and a gate electrode thereof is configured to receive the light-emission control signal.

As such, the manipulating the light-emission control signal and the gate signal in the writing-compensation control stage comprises: applying a turn-off signal as the light-emission control signal and applying a turn-on signal as the gate signal; and the manipulating the light-emission control signal and the gate signal in the light-emission control stage comprises: applying a turn-on signal as the light-emission control signal and applying a turn-off signal as the gate signal;

In the above embodiments of the method, each of the first transistor, the second transistor, the third transistor, the fourth transistor, and the fifth transistor can be a P-type transistor. As such, the applying a turn-off signal as the light-emission control signal and applying a turn-on signal as the gate signal comprises: applying a high-level signal as the light-emission control signal and applying a low-level signal as the gate signal; and the applying a turn-on signal as the light-emission control signal and applying a turn-off signal as the gate signal comprises: applying a low-level signal as the light-emission control signal and applying a high-level signal as the gate signal.

According to some embodiments of the method, each of the at least one display cycle further comprises, prior to the writing-compensation control stage, an initiation stage. The initiation stage comprises: manipulating the light-emission control signal and the gate signal, such that the first node does not receive the data signal, the second node does not receive the third voltage signal, and the second electrode of the driving sub-circuit is electrically disconnected from the third electrode of the driving sub-circuit; and that the first node is electrically disconnected from the second node, and the second electrode of the driving sub-circuit is electrically disconnected from the light-emission sub-circuit.

In the above embodiments of the method, the pixel driving circuit can further comprise a first initiating sub-circuit, which is electrically coupled with the light-emission sub-circuit. The first initiating sub-circuit is configured to receive a first initiating signal and a first initiating control signal, and is further configured, under control of the first initiating control signal, to control whether the light-emission sub-circuit receives the first initiating signal. As such, the initiation stage further comprises: manipulating the first initiating control signal such that the first initiating signal is written to the first electrode of the light-emission sub-circuit to realize an initiation of the light-emission sub-circuit.

In the above embodiments of the method, the pixel driving circuit can alternatively further comprise a second initiating sub-circuit, which is electrically coupled with the first node. The second initiating sub-circuit is configured to receive a second initiating signal and a second initiating control signal, and is further configured, under control of the second initiating control signal, to control whether the first node receives the second initiating signal. As such, the initiation stage further comprises: manipulating the second initiating control signal such that the second initiating signal is written to the first node to realize an initiation of the light-emission sub-circuit.

In a third aspect, the present disclosure further provides a display apparatus. The display apparatus comprises a pixel driving circuit according to any one of the embodiments as described above.

BRIEF DESCRIPTION OF DRAWINGS

In order to clearly illustrate various embodiments in the invention disclosed herein, the following are accompanying drawings in the description of the embodiments, which are introduced briefly herein.

It is noted that these drawings shall be regarded to represent only some, but not all, of the embodiments of the present disclosure. For those skilled in the art, other embodiments may become apparent based on the structures as illustrated in these accompanying drawings.

DETAILED DESCRIPTION

Various embodiments of the present disclosure are described below with specific examples, and other advantages and effects of the present disclosure can be easily understood by those skilled in the field of technology from the contents disclosed in this specification.

Apparently, the described embodiments are only a part of embodiments in the present disclosure, rather than all of them. The present disclosure can also be implemented or applied through different specific embodiments, and various details of the specification can also be modified or changed based on different viewpoints and applications without departing from the spirit of the present disclosure.

Based on the embodiments in the present disclosure, all the other embodiments acquired by those skilled in the art on the premise of not paying creative labor are in the protection scope of the present disclosure. It should be noted that, on the premise that there is no conflict, the following embodiments and the features in the embodiments can be combined together.

In a first aspect, the present disclosure provides a pixel driving circuit.

Figure 1:
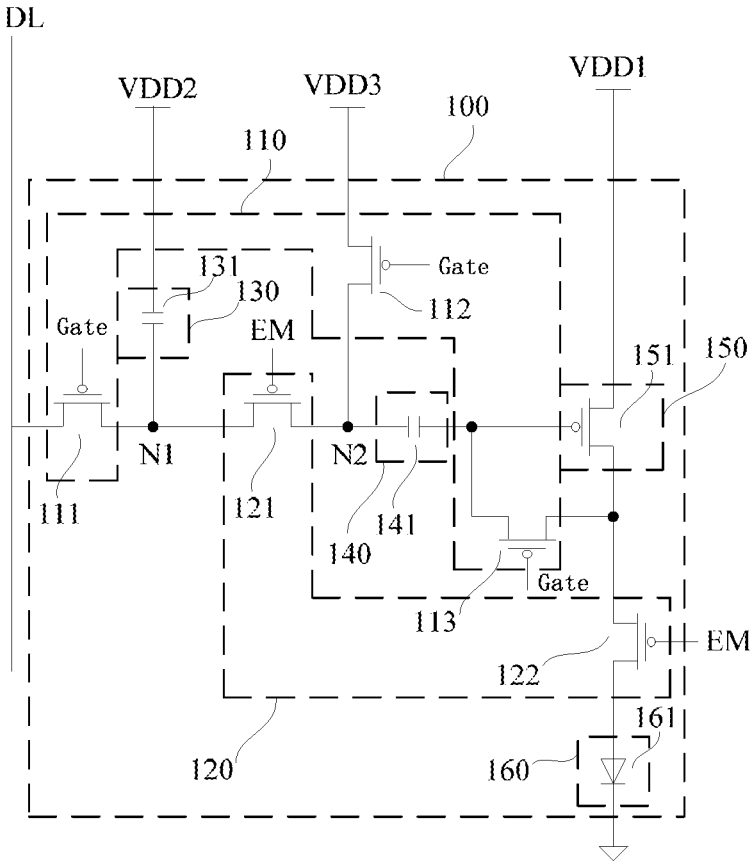
FIG. 1 illustrates a circuit diagram of a pixel driving circuit according to some embodiments of the present disclosure.

FIG. 1 illustrates a circuit diagram of a pixel driving circuit according to some embodiments of the present disclosure. As shown in FIG. 1, the pixel driving circuit 100 includes a writing-compensation control sub-circuit 110, a light-emission control sub-circuit 120, a first storage sub-circuit 130, a second storage sub-circuit 140, a driving sub-circuit 150, and a light-emission sub-circuit 160.

A first electrode of the driving sub-circuit 150 is electrically coupled or electrically connected to a first voltage input terminal VDD1, and is configured to receive a first voltage signal Vdd1 from the first voltage input terminal VDD1. A second electrode of the driving sub-circuit 150 is electrically coupled/connected to the light-emission control sub-circuit 120, and is further coupled to the light-emission sub-circuit 160 via the light-emission control sub-circuit 120, and is thereby configured to control the light-emission sub-circuit 160 to emit lights. A third electrode of the driving sub-circuit 150 is electrically coupled/connected to a first electrode of the second storage sub-circuit 140.

A first electrode of the first storage sub-circuit 130 is electrically coupled/connected to a first node N1. A second electrode of the first storage sub-circuit 130 is electrically coupled/connected to a second voltage input terminal VDD2, and is configured to receive a second voltage signal Vdd2 from the second voltage input terminal VDD2.

The first electrode of the second storage sub-circuit 140 is electrically coupled to the third electrode of the driving sub-circuit 150, and a second electrode of the second storage sub-circuit 140 is electrically coupled to a second node N2.

The writing-compensation control sub-circuit 110 is electrically coupled to a data line DL, a gate line Gate, a third voltage input terminal VDD3, the first node N1, and the second node N2, respectively. The writing-compensation control sub-circuit 110 is configured to receive a data signal Vdata from the data line DL, a gate signal Vgate from the gate line Gate, and a third voltage signal Vdd3 from the third voltage input terminal VDD3.

Herein, the third voltage input terminal VDD3 and the first voltage input terminal VDD1 are configured to be a same voltage input terminal, and thus the signal from the third voltage input terminal VDD3 (i.e. Vdd3) and the signal from the first voltage input terminal VDD1 (i.e. Vdd1) are same, i.e. Vdd1=Vdd3.

In addition, the second voltage input terminal VDD2 and the first voltage input terminal VDD1 are configured to be a same voltage input terminal, and thus the signal from the second voltage input terminal VDD2 (i.e. Vdd2) and the signal from the first voltage input terminal VDD1 (i.e. Vdd1) are same, i.e. Vdd1=Vdd2.

As such, the signal form the first voltage input terminal VDD1 (i.e. Vdd1), the signal from the second voltage input terminal VDD2 (i.e. Vdd2), and the third voltage input terminal VDD3 (i.e. Vdd3) are same, i.e. i.e. Vdd1=Vdd2=Vdd3=Vdd.

The writing-compensation control sub-circuit 110 is configured to control an electrical conductance between the first node N1 and the data line DL under control of the gate signal Vgate, and is thus able to control whether the first node N1 can receive the data signal Vdata from the data line DL.

The writing-compensation control sub-circuit 110 is further configured to control an electrical conductance between the second node N2 and the third voltage input terminal VDD3 under control of the gate signal Vgate, and is thus able to control whether the second node N2 can receive the third voltage signal Vdd3 from the third voltage input terminal VDD3.

The writing-compensation control sub-circuit 110 is further configured to control an electrical conductance between the third electrode of the driving sub-circuit 150 and the second electrode of the driving sub-circuit 150 under control of the gate signal Vgate.

The light-emission control sub-circuit 120 is electrically coupled to a light-emission control signal line EM, the first node N1, the second node N2, the second electrode of the driving sub-circuit 150, and the light-emission sub-circuit 160.

The light-emission control sub-circuit 120 is configured to receive a light-emission control signal Vem from the light-emission control signal line EM. The light-emission control sub-circuit 120 is further configured to control an electrical conductance between the first node N1 and the second node N2 under control of the light-emission control signal Vem, and the light-emission control sub-circuit 120 is also configured to control an electrical conductance between the second electrode of the driving sub-circuit 150 and the light-emission sub-circuit 160 under control of the light-emission control signal Vem.

Specifically, the driving sub-circuit 150 can include a driving transistor 151. The driving transistor 151 can be a P-type transistor. A source electrode, a drain electrode, and a gate electrode of the driving transistor 151 can respectively be the first electrode, the second electrode, and the third electrode of the driving sub-circuit 150.

The aforementioned embodiments of the pixel driving circuit are herein described with a driving transistor 151 as the driving sub-circuit 150. It is noted that it serves only as an illustrating example, and other embodiments are possible. For example, the driving sub-circuit 150 can also include other components that can be combined with a driving transistor, such as resistors or inductors. These components together constitute the driver circuit 150 to realize the purported function of the driver circuit 150.

Specifically, the light-emission sub-circuit 160 can include a light-emitting component 161, which is electrically coupled to the drain electrode of the driving transistor 151, and is configured to emit lights under driving of the driving transistor 151.

Specifically, the writing-compensation control sub-circuit 110 can include a first transistor 111, a second transistor 112, and a third transistor 113. A source electrode of the first transistor 111 is electrically coupled to the data line DL, and is configured to receive the data signal Vdata from the data line DL. A drain electrode of the first transistor 111 is electrically coupled to the first node N1. A gate electrode of the first transistor 111 is electrically coupled to the gate line Gate, and is configured to receive the gate signal Vgate from the gate line Gate.

A source electrode of the second transistor 112 is electrically coupled to the third voltage input terminal VDD3, and is configured to receive the third voltage signal from the third voltage input terminal VDD3. A drain electrode of the second transistor 112 is electrically coupled to the second node N2. A gate electrode of the second transistor 112 is electrically coupled to the gate line Gate, and is configured to receive the gate signal Vgate from the gate line Gate.

A source electrode of the third transistor 113 is electrically coupled to the second electrode of driving sub-circuit 150, i.e., the source electrode of the third transistor 113 is electrically coupled to the drain electrode of the driving transistor 151. A drain electrode of the third transistor 113 is electrically coupled to the third electrode of the driving sub-circuit 150, i.e., the drain electrode of the third transistor 113 is electrically coupled to the gate electrode of the driving transistor 151. A gate electrode of the third transistor 113 is electrically coupled to the gate line Gate, and is configured to receive the gate signal Vgate from the gate line Gate.

Further specifically, the light-emission control sub-circuit 120 can include a fourth transistor 121 and a fifth transistor 122. A source electrode of the fourth transistor 121 is electrically coupled to the first node N1. A drain electrode of the fourth transistor 121 is electrically coupled to the second node N2. A gate electrode of the fourth transistor 121 is electrically coupled to the light-emission control signal line EM, and is thus configured to receive the light-emission control signal Vem from the light-emission control signal line EM.

A source electrode of the fifth transistor 122 is electrically coupled to the second electrode of the driving sub-circuit 150, i.e. the source electrode of the fifth transistor 122 is electrically coupled to the drain electrode of the driving transistor 151. A drain electrode of the fifth transistor 122 is electrically coupled to the light-emitting component 161. A gate electrode of the fifth transistor 122 is electrically coupled to the light-emission control signal line EM, and is thus configured to receive the light-emission control signal Vem from the light-emission control signal line EM.

In the embodiments of the pixel driving circuits as described above, all transistors besides the driving transistor 151 (i.e. the first transistor 111, the second transistor 112, the third transistor 113, the fourth transistor 121, and the fifth transistor 122) can each be a P-type transistor.

It is noted that these above embodiments shall be interpreted as illustrating examples only, and other embodiments are also possible. For example, each of these other transistors except the driving transistor 151 (i.e. the first transistor 111, the second transistor 112, the third transistor 113, the fourth transistor 121, and the fifth transistor 122) can each be a N-type transistor, whose time sequence of the control signal can be altered accordingly when a control is needed. There are no limitations herein regarding the type of transistors, yet in the following, detailed description is given with each of the transistors, including the driving transistor 151, the first transistor 111, the second transistor 112, the third transistor 113, the fourth transistor 121, and the fifth transistor 122, being a P-type transistor.

Further specifically, the first storage sub-circuit 130 can include a first storage capacitor 131. A first electrode of the first storage capacitor 131 is electrically coupled to the first node N1. A second electrode of the first storage capacitor 131 is electrically coupled to the second voltage input terminal VDD2, and is configured to receive the second voltage signal Vdd2 from the second voltage input terminal VDD2.

It is noted herein that the first storage sub-circuit 130 is illustratively described with it being a first storage capacitor 131. Other embodiments are possible. For example, the first storage sub-circuit 130 can also include other components that can be combined with the first storage capacitor 131, such as resistors or capacitors. These components together can realize the purported function of the first storage sub-circuit 130. In one specific example, the first storage sub-circuit 130 can include at least two first storage capacitors.

Further specifically, the second storage sub-circuit 140 can include a second storage capacitor 141. A first electrode of the second storage capacitor 141 is electrically coupled to the third electrode of the driving sub-circuit 150, i.e. the first electrode of the second storage capacitor 141 is electrically coupled to the gate electrode of the driving transistor 151. A second electrode of the second storage capacitor 141 is electrically coupled to the drain electrode of the second transistor 112, and is further electrically coupled to the third voltage input terminal VDD3 via the second transistor 112. As such, the second electrode of the second storage capacitor 141 is configured to receive the third voltage signal Vdd3 from the third voltage input terminal VDD3.

It is noted herein that the second storage sub-circuit 140 is illustratively described with it being a second storage capacitor 141. Other embodiments are possible. For example, the second storage sub-circuit 140 can also include other components that can be combined with the second storage capacitor 141, such as resistors or capacitors. These components together can realize the purported function of the second storage sub-circuit 140. In one specific example, the second storage sub-circuit 140 can include at least two second storage capacitors.

In a second aspect, the present disclosure further provides a method for driving a pixel driving circuit. The pixel driving circuit can be the embodiments as illustrated in FIG. 1.

Figure 2:
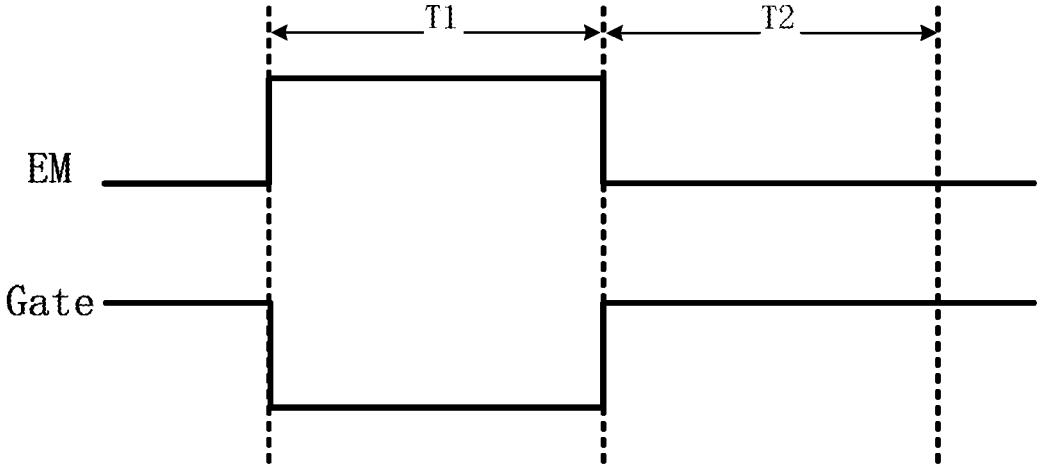
FIG. 2 illustrates a time sequence diagram of the pixel driving circuit as shown in FIG. 1.

Specifically, FIG. 2 illustrates a time sequence diagram of the pixel driving circuit 100 as shown in FIG. 1. As shown in FIG. 2, the method for driving the pixel driving circuit 100 substantially comprises a display cycle which alternately includes a writing-compensation control stage T1 and a light-emission control stage T2.

Specifically, the method includes a writing-compensation control stage T1, when the light-emission control signal Vem from the light-emission control signal line EM is a high-level signal, and the gate signal Vgate from the gate line Gate is a low-level signal. As such, under control of the light-emission control signal Vem, the light-emission control sub-circuit 120 can control the electrical disconnection between the first node N1 and the second node N2, and the light-emission control sub-circuit 120 can further control the electrical disconnection between the second electrode of the driving sub-circuit 150 and the light-emission sub-circuit 160.

Specifically, during the writing-compensation control stage T1 of each display cycle, the light-emission control signal line EM can send the light-emission control signal Vem to both the fourth transistor 121 and the fifth transistor 122. Under the light-emission control signal Vem, the source electrode and the drain electrode of the fourth transistor 121 are not electrically connected, thus the first node N1 and the second node N2 are electrically disconnected. Additionally, under the light-emission control signal Vem, the source electrode and the drain electrode of the fifth transistor 122 are not electrically connected, thus the drain electrode of the driving transistor 151 and the light-emission sub-circuit 160 are electrically disconnected.

Further under control of the gate signal Vgate, the writing-compensation control sub-circuit 110 controls an electrical connection between the data line DL and the first node N1, and in turn the data line DL is electrically connected with the first electrode of the first storage sub-circuit 130. As such, the writing-compensation control sub-circuit 110 controls that the data signal Vdata can be inputted or written to the first storage sub-circuit 130 and that the first node N1 has a potential of Vdata.

Additionally, under control of the gate signal Vgate, the writing-compensation control sub-circuit 110 controls an electrical connection between the second node N2 and the third voltage input terminal VDD3, and in turn the second node N2 can receive the third voltage signal Vdd3 from the third voltage input terminal VDD3, and the second node N2 has a potential of Vdd3.

Additionally, under control of the gate signal Vgate, the writing-compensation control sub-circuit 110 controls an electrical connection between the second electrode of the driving sub-circuit 150 and the third electrode of the driving sub-circuit 150, which in turn causes that the level at the third electrode of the driving sub-circuit 150 is $$Vdd+Vth; \tag{1}$$

where Vdd is the first voltage signal Vdd1 that the first electrode of the driving sub-circuit 150 revives from the first voltage input terminal VDD1 (because Vdd1=Vdd), and Vth is a threshold voltage of the driving sub-circuit 150.

Specifically, during the writing-compensation control stage T1 of each display cycle, the gate line Gate sends the gate signal Vgate to the first transistor 111, the second transistor 112, and the third transistor 113.

Under control of the gate signal Vgate, the source electrode and the drain electrode of the first transistor 111 are electrically connected, causing the data line DL to be electrically connected to the first electrode of the first storage capacitor 131. As such, the data signal Vdata is inputted or written to the first storage capacitor 131, and the first node has a potential of Vdata.

Further under control of the gate signal Vgate, the source electrode and the drain electrode of the second transistor 112 are electrically connected, causing the second node N2 to be electrically connected to the third voltage input terminal VDD3. As such, when the third voltage signal Vdd3 is applied to the third voltage input terminal VDD3, the second node N2 has a potential of Vdd (because Vdd3=Vdd).

Further under control of the gate signal Vgate, the source electrode and the drain electrode of the third transistor 113 are electrically connected, causing the second electrode of the driving sub-circuit 150 to be electrically connected with the third electrode of the driving sub-circuit 150. As such, when the first voltage signal Vdd1 is applied to the first voltage input terminal VDD1, the source electrode and the drain electrode of the driving transistor 151 are electrically connected, and the first voltage signal Vdd1 is transmitted from the source electrode to the drain electrode, and the first voltage signal Vdd1 is further transmitted to the gate electrode of the driving transistor 151 via the third transistor 113. Then after electrical disconnection between the source electrode and the drain electrode of the driving transistor 151, the gate electrode of the driving transistor 151 has a potential of Vdd+Vth after stabilization.

During the light-emission control stage T2 of each display cycle, the light-emission control signal Vem inputted from the light-emission control signal line EM is a low-level signal, and the gate signal Vgate inputted from the gate line Gate is a high-level signal.

Under control of the gate signal Vgate, the writing-compensation control sub-circuit 110 controls that the first node N1 is electrically disconnected with the data line DL, causing that the first node N1 does not receive the data signal Vdata. Because in the above writing-compensation control stage T1, the first node N1 has a potential of Vdata, at the light-emission control stage T2, the first node N1 still has a potential of Vdata.

Further under control of the gate signal Vgate, the writing-compensation control sub-circuit 110 controls that the second node N2 is electrically disconnected with the third voltage input terminal VDD3, causing that the second node N2 does not receive the third voltage signal Vdd3 from the third voltage input terminal VDD3.

Additionally, under control of the gate signal Vgate, the writing-compensation control sub-circuit 110 controls that the second electrode of the driving sub-circuit 150 is electrically disconnected with the third electrode of the driving sub-circuit 150.

Specifically, under control of the gate signal Vgate, the source electrode and the drain electrode of the first transistor 111 are electrically disconnected, the first node N1 is electrically disconnected with the data line DL, and the first node N1 still has a potential of Vdata. Additionally, under control of the gate signal Vgate, the source electrode and the drain electrode of the second transistor 112 are electrically disconnected, the second node N2 is electrically disconnected with the third voltage input terminal VDD3. Furthermore, under control of the gate signal Vgate, the source electrode and the drain electrode of the third transistor 113 are electrically disconnected, the drain electrode and the gate electrode of the second transistor 112 are electrically disconnected.

Under control of the light-emission control signal Vem, the light-emission control sub-circuit 120 controls that the first node N1 is electrically connected with the second node N2, causing that the second node N2 has a potential of Vdata. Further under control of the light-emission control signal Vem, the light-emission control sub-circuit 120 controls that the second electrode of the driving sub-circuit 150 is electrically connected with the light-emission sub-circuit 160, in turn causing the light-emission sub-circuit 160 to emit lights.

Specifically, under control of the light-emission control signal Vem, the source electrode and the drain electrode of the fourth transistor 121 are electrically connected, thus the first node N1 is electrically connected with the second node N2, causing that each of the first node N1 and the second node N2 has a potential of Vdata. Additionally, under the light-emission control signal Vem, the source electrode and the drain electrode of the fifth transistor 122 are electrically connected, thus the drain electrode of the driving transistor 151 is electrically connected with the light-emitting component 161 in the light-emission sub-circuit 160, causing that the first voltage signal Vdd1 from the first voltage input terminal VDD1 is able to pass through the driving transistor 151 to thereby drive the light-emitting component 161 to emit lights.

During the writing-compensation control stage T1, because each of the first transistor 111, the second transistor 112, the third transistor 113 is electrically turned on under control of the gate signal Vgate, whereas each of the fourth transistor 121 and the fifth transistor 122 is electrically turned off under control of the light-emission control signal Vem, the first node N1 has a potential of Vdata, the first electrode of the first storage capacitor 131 has a same potential as the first node N1 and thus also has a potential of Vdata.

Because the second electrode of the first storage capacitor 131 is connected to the second voltage input terminal VDD2, the second electrode of the first storage capacitor 131 has a potential of Vdd (because Vdd2=Vdd). Because of the second node N2 is electrically connected to the third voltage input terminal VDD3 via the second transistor 112, the second node N2 has a potential of Vdd (because Vdd3=Vdd).

Because the second electrode of the second storage capacitor 141 is electrically connected to the second node N2, the second electrode of the second storage capacitor 141 has a potential of Vdd. Because the first electrode of the second storage capacitor 141 is connected to the gate electrode of the driving transistor 151, and also because the third transistor 113 is equivalent to a turned-on diode, which allows only one-direction conduction, therefore the first electrode of the second storage capacitor 141 has a potential of Vdd+Vth.

During the light-emission control stage T2, each of the fourth transistor 121 and the fifth transistor 122 is electrically turned on under control of the light-emission control signal Vem, whereas each of the first transistor 111, the second transistor 112, the third transistor 113 is electrically turned off under control of the gate signal Vgate. As such, the first node N1 still has a potential of Vdata, the first electrode of the first storage capacitor 131 still has a potential of Vdata, and the second electrode of the first storage capacitor 131 still has a potential of Vdd.

As to the second node N2, because the second node N2 is electrically connected to the first node N1, and the second node N2 is electrically disconnected to the third voltage input terminal VDD3, as such, the second node N2 has a potential of Vdata. Furthermore, because the second electrode of the second storage capacitor 141 is electrically connected to the second node N2, the second electrode of the second storage capacitor 141 also has a potential of Vdata.

Regardless of the writing-compensation control stage T1 or the light-emission control stage T2, the total electrical charge in the first storage capacitor 131 and in the second storage capacitor 141 remains unchanged, which can be respectively calculated by the formula (2):

$$C2\times U21+C1\times U11=C2\times U22+C1\times U12; \quad (2)$$

where C1 is the capacitance of the first storage capacitor 131, C2 is the capacitance of the second storage capacitor 141, U11 is the voltage between the first electrode and the second electrode of the first storage capacitor 131 during the writing-compensation control stage T1, U21 is the voltage between the first electrode and the second electrode of the second storage capacitor 141 during the writing-compensation control stage T1, U12 is the voltage between the first electrode and the second electrode of the first storage capacitor 131 during the light-emission control stage T2, U22 is the voltage between the first electrode and the second electrode of the second storage capacitor 141 during the light-emission control stage T2.

After substituting each parameter in the formula (2), the following formula (3) is further obtained:

$$C2\times(Vdd+Vth-Vdd+C1\times(Vdd-V\text{data})=C2\times(Vg-V\text{data})+C1\times(Vdd-V\text{data}); \quad (3)$$

After reduction of the above formula (3), the formula (4) is obtained.

$$Vg=V\text{data}+Vth; \quad (4)$$

where Vg is the potential at the first electrode of the second storage capacitor 141. Because the first electrode of the second storage capacitor 141 is electrically connected to the gate electrode of the driving transistor 151, the gate electrode of the driving transistor 151 also has a potential of Vg. In other words, during the light-emission control stage T2, the potential at the gate electrode of the driving transistor 151 is Vdata+Vth.

Furthermore, if the current characteristics of the driving transistor 151 is considered, i.e., in the calculation of the current, if the driving transistor 151 has a characteristics of a constant current, the formula (5) is satisfied:

$$Vds=Vgs-Vth; \quad (5)$$

After the substitution of formula (5), the formula (6) is obtained:

$$Vgs-Vth=V\text{data}+Vth-Vth-Vdd=V\text{data}-Vdd; \quad (6)$$

As illustrated by the formula (6), during the light-emission control stage T2, when the driving transistor 151 has a characteristics of a constant current, Vds=Vdata−Vdd. In other words, the current that runs through the driving transistor 151 and drives the light-emission component 161 is related to Vdata−Vdd, but is not related to the threshold voltage Vth of the driving transistor 151.

As such, when emitting lights, the light-emission component 161 is not influenced by deviation or drifting of the threshold voltage Vth of the driving transistor 151. Thereby, thought the pixel driving circuit disclosed herein, the threshold voltage Vth of the driving transistor 151 is compensated for the deviation or drifting thereof, and the voltage writing is also combined with the threshold voltage compensation.

Compared with the traditional OLED display technologies, which typically have four stages including a reset stage, threshold voltage compensation stage, a data signal writing stage, and a light emission stage, the pixel driving circuit disclosed herein allows a reduction to only two stages. As such, the non-light-emission time period is effectively reduced, the response speed of the pixel circuit is increased, in turn realizing a consistent and even brightness among different pixels, leading to an even brightness of the display apparatus.

It is noted that the above embodiments of the pixel driving circuit and its driving method are illustrated with the third voltage input terminal VDD3 and the first voltage input terminal VDD1 being a same voltage input terminal, yet other embodiments are also possible.

Figure 3:
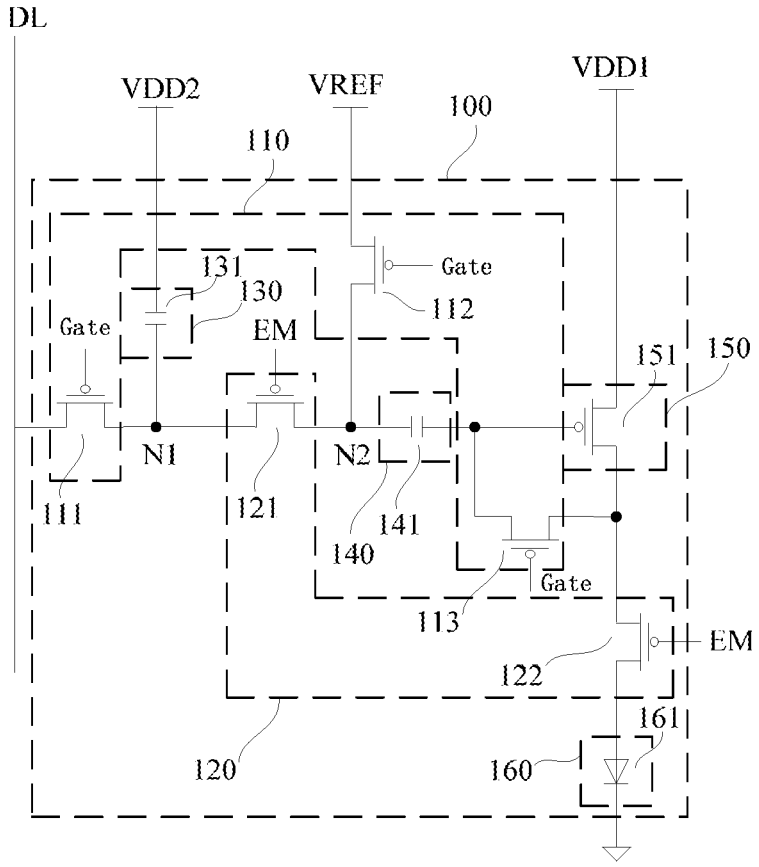
FIG. 3 illustrates a circuit diagram of a pixel driving circuit according to some other embodiments of the present disclosure.

FIG. 3 illustrates a circuit diagram of a pixel driving circuit according to some other embodiments of the present disclosure. As shown in FIG. 3, the third voltage input terminal VREF and the first voltage input terminal VDD1 are different voltage input terminals. In other words, the third voltage signal from the third voltage input terminal VREF is substantially different from the first voltage signal from the first voltage input terminal VDD1.

Correspondingly, during the writing-compensation control stage T1, because each of the first transistor 111, the second transistor 112, the third transistor 113 is electrically turned on under control of the gate signal Vgate, whereas each of the fourth transistor 121 and the fifth transistor 122 is electrically turned off under control of the light-emission control signal Vem, the first node N1 has a potential of Vdata, the first electrode of the first storage capacitor 131 has a same potential as the first node N1 and thus also has a potential of Vdata.

Because the second electrode of the first storage capacitor 131 is connected to the second voltage input terminal VDD2, the second electrode of the first storage capacitor 131 has a potential of Vdd (because Vdd2=Vdd). Because the second node N2 is electrically connected to the third voltage input terminal VREF via the second transistor 112, the second node N2 has a potential of Vref.

Because the second electrode of the second storage capacitor 141 is electrically connected to the second node N2, the second electrode of the second storage capacitor 141 has a potential of Vref. Because the first electrode of the second storage capacitor 141 is connected to the gate electrode of the driving transistor 151, and also because the third transistor 113 is equivalent to a turned-on diode, which allows only one-direction conduction, therefore the first electrode of the second storage capacitor 141 has a potential of Vref+Vth.

During the light-emission control stage T2, each of the fourth transistor 121 and the fifth transistor 122 is electrically turned on under control of the light-emission control signal Vem, whereas each of the first transistor 111, the second transistor 112, and the third transistor 113 is electrically turned off under control of the gate signal Vgate. As such, the first node N1 still has a potential of Vdata, the first electrode of the first storage capacitor 131 still has a potential of Vdata, and the second electrode of the first storage capacitor 131 still has a potential of Vdd.

As to the second node N2, because the second node N2 is electrically connected to the first node N1, and the second node N2 is electrically disconnected to the third voltage input terminal VREF, as such, the second node N2 has a potential of Vdata. Furthermore, because the second electrode of the second storage capacitor 141 is electrically connected to the second node N2, the second electrode of the second storage capacitor 141 also has a potential of Vdata.

Regardless of the writing-compensation control stage T1 or the light-emission control stage T2, the total electrical charge in the first storage capacitor 131 and in the second storage capacitor 141 remains unchanged, which can be respectively calculated by the formula (2):

$$C2\times U21+C1\times U11=C2\times U12+C1\times U12; \quad (2)$$

where C1 is the capacitance of the first storage capacitor 131, C2 is the capacitance of the second storage capacitor 141, U11 is the voltage between the first electrode and the second electrode of the first storage capacitor 131 during the writing-compensation control stage T1, U21 is the voltage between the first electrode and the second electrode of the second storage capacitor 141 during the writing-compensation control stage T1, U12 is the voltage between the first electrode and the second electrode of the first storage capacitor 131 during the light-emission control stage T2, U22 is the voltage between the first electrode and the second electrode of the second storage capacitor 141 during the light-emission control stage T2.

After substituting each parameter in the formula (2), the following formula (7) is further obtained:

$$C2\times(Vdd+Vth-V\text{ref})+C1\times(Vdd-V\text{data})=C2\times(Vg-V\text{data})+C1\times(Vdd-V\text{data}); \quad (7)$$

After reduction of the above formula (7), the formula (8) is obtained.

$$Vg=Vdd+Vth+V\text{data}-V\text{ref}; \quad (8)$$

where Vg is the potential at the first electrode of the second storage capacitor 141. Because the first electrode of the second storage capacitor 141 is electrically connected to the gate electrode of the driving transistor 151, the gate electrode of the driving transistor 151 also has a potential of Vg.

In other words, during the light-emission control stage T2, the potential at the gate electrode of the driving transistor 151 is Vdd+Vth+Vdata−Vref.

Furthermore, if the current characteristics of the driving transistor 151 is considered, i.e., in the calculation of the current, if the driving transistor 151 has a characteristics of a constant current, the formula (5) is satisfied:

$$Vds=Vgs-Vth; \quad (5)$$

After the substitution of formula (5) in formula (8), the formula (9) is obtained:

$$Vgs-Vth=Vdd+Vth+V\text{data}-V\text{ref}-Vth-Vdd=V\text{data}-V\text{ref}; \quad (9)$$

As illustrated by the formula (9), during the light-emission control stage T2, when the driving transistor 151 has a characteristics of a constant current, Vds=Vdata−Vref. In other words, the current that runs through the driving transistor 151 and drives the light-emission component 161 is related to Vdata−Vref, but is not related to the threshold voltage Vth of the driving transistor 151.

As such, when emitting lights, the light-emission component 161 is not influenced by deviation or drifting of the threshold voltage Vth of the driving transistor 151. Thereby, thought the pixel driving circuit disclosed herein, the threshold voltage Vth of the driving transistor 151 is compensated for the deviation or drifting thereof, and the voltage writing is also combined with the threshold voltage compensation.

Compared with the traditional OLED display technologies, which typically have four stages including a reset stage, threshold voltage compensation stage, a data signal writing stage, and a light emission stage, the pixel driving circuit disclosed herein allows a reduction to only two stages. As such, the non-light-emission time period is effectively reduced, the response speed of the pixel circuit is increased, in turn realizing a consistent and even brightness among different pixels, leading to an even brightness of the display apparatus.

Furthermore, the light-emission control stage of the pixel driving circuit is related to Vref, but is not related to Vdd. As such, the influence of the voltage drop (i.e. IR drop) of Vdd on the driving circuit can be effectively avoided, leading to a further improved display effect.

Figure 4:
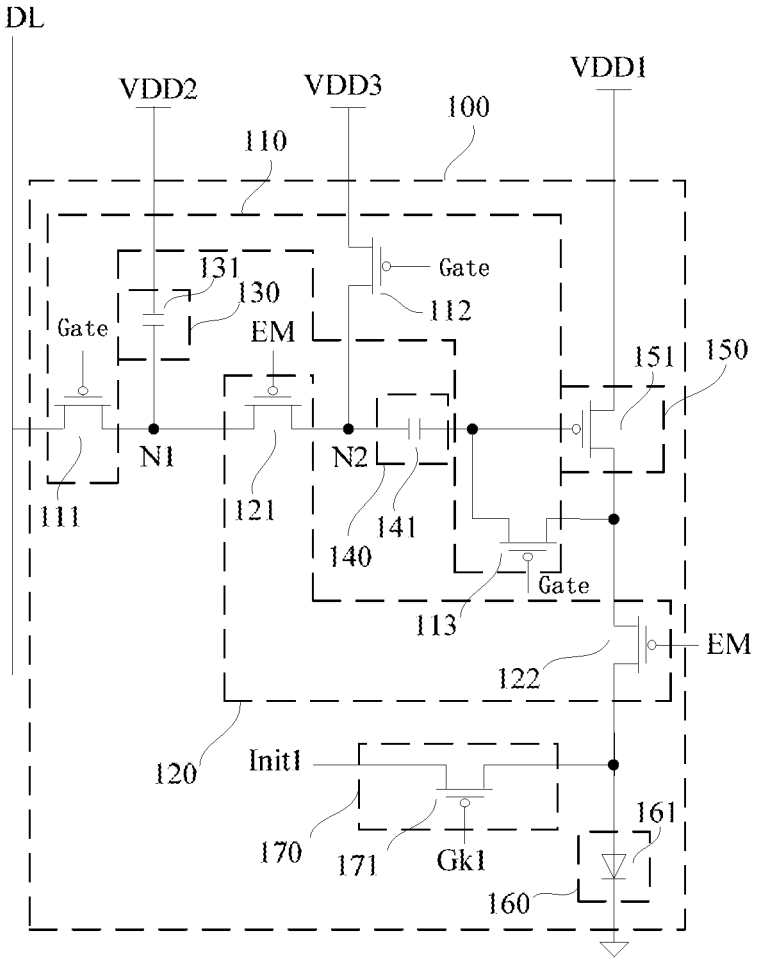
FIG. 4 illustrates a circuit diagram of a pixel driving circuit according to yet some other embodiments of the present disclosure.

FIG. 4 illustrates a circuit diagram of a pixel driving circuit according to yet some other embodiments of the present disclosure. Compared with the embodiments illustrated in FIG. 1, the embodiments of the pixel driving circuit illustrated in FIG. 4 further comprises a first initiating sub-circuit 170.

The first initiating sub-circuit 170 is electrically coupled with the light-emission sub-circuit 160, and is specifically between the first initiating signal line Init1 and the light-emission sub-circuit 160. Additionally, the first initiating sub-circuit 170 is electrically connected to a first initiating control signal line Gk1.

The first initiating sub-circuit 170 is configured to receive a first initiating control signal Vgk1 from the first initiating control signal line Gk1, and is further configured, under control of the first initiating control signal Vgk1, to control whether the light-emission sub-circuit 160 is electrically connected with the first initiating signal line Init1, to thereby control whether the light-emission sub-circuit 160 can receive a first initiating signal Vinit1 from the first initiating signal line Init1.

Specifically, the first initiating sub-circuit 170 comprises a first initiating transistor 171. A source electrode of the first initiating transistor 171 is electrically coupled to the first initiating signal line Init1, and is configured to receive the first initiating signal Vinit1 from the first initiating signal line Init1. A drain electrode of the first initiating transistor 171 is electrically coupled to the light-emission component 161 of the light-emission sub-circuit 160. A gate electrode of the first initiating transistor 171 is electrically coupled to the first initiating control signal line Gk1, and is configured to receive first initiating control signal Vgk1 from the first initiating control signal line Gk1.

The first initiating transistor 171 is configured, under control of the first initiating control signal Vgk1, to control whether the source electrode and the drain electrode of the first initiating transistor 171 are electrically connected, in turn controlling whether the light-emission component 161 of the light-emission sub-circuit 160 is electrically connected with the first initiating signal line Init1, to thereby control whether the light-emission component 161 can receive the first initiating signal Vinit1 from the first initiating signal line Init1.

Figure 5:
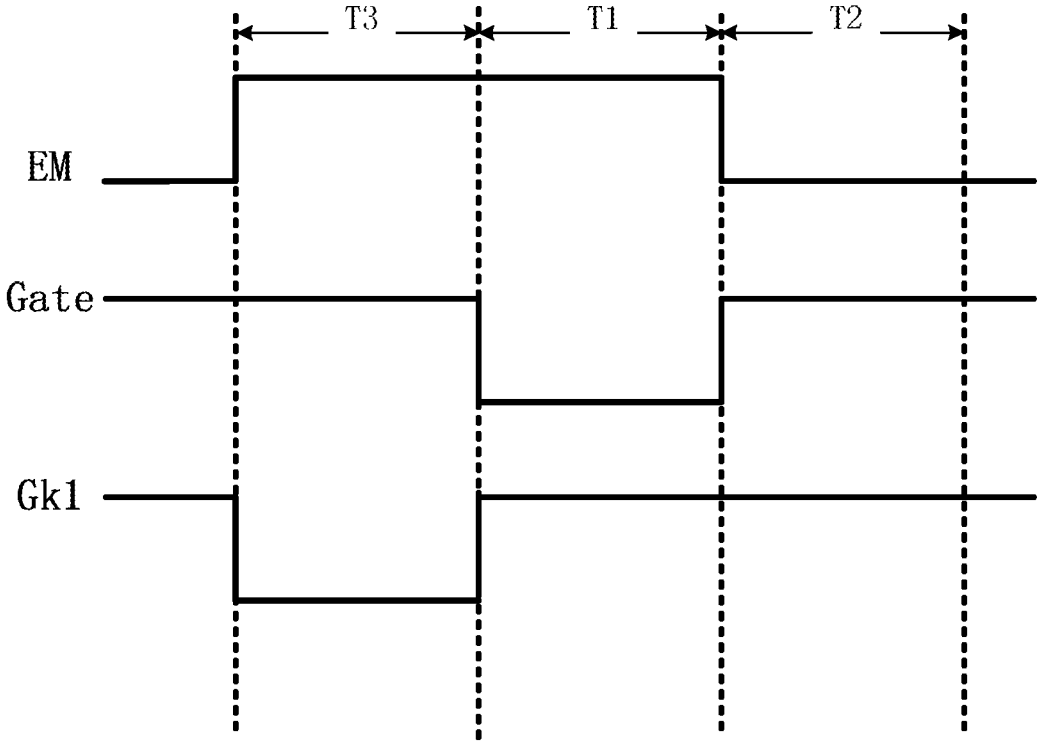
FIG. 5 illustrates a time sequence diagram of the pixel driving circuit as shown in FIG. 4.

FIG. 5 illustrates a time sequence diagram of the pixel driving circuit as shown in FIG. 4. As shown in FIG. 5, each display cycle of the pixel driving circuit as illustrated in FIG. 4 further includes an initiation stage T3 prior to the writing-compensation control stage T1.

Correspondingly, the method for driving a pixel driving circuit 100 according to the above mentioned embodiments illustrated in FIG. 4 is further provided. Specifically, during the initiation stage T3, the first initiating control signal Vgk1 from the first initiating control signal line Gk1 is a low-level signal, the light-emission control signal Vem inputted from the light-emission control signal line EM is a high-level signal, and the gate signal Vgate inputted from the gate line Gate is a high-level signal.

Under control of the first initiating control signal Vgk1, the first initiating sub-circuit 170 controls that the light-emission sub-circuit 160 is electrically connected to the first initiating signal line Init1, and further controls that the light-emission sub-circuit 160 receives the first initiating signal Vinit1 from the first initiating signal line Init1, such that the first initiating signal Vinit1 is written or inputted to the first electrode of the light-emission sub-circuit 160 to realize an initiation of the light-emission sub-circuit 160. As such, the first electrode of the light-emission sub-circuit 160 is set at a low level prior to the writing-compensation control stage T1 and the light-emission control stage T2, ensuring that no light is emitting from any pixels, to in turn increase the contrast of the display panel.

Specifically, during the initiation stage T3, under control of the first initiating control signal Vgk1, the source electrode and the drain electrode of the first initiating transistor 171 are electrically connected, causing the light-emission sub-circuit 160 to be electrically connected to the first initiating signal line Init1. Thereby, the light-emission sub-circuit 160 can receive the first initiating signal Vinit1 from the first initiating signal line Init1 to thereby realize the initiation process.

Furthermore, during the initiation stage T3, under control of the gate signal Vgate, the writing-compensation control sub-circuit 110 controls that the first node N1 is electrically disconnected from the data line DL, and thus the first node N1 does not receive the data signal Vdata.

Additionally under control of the gate signal Vgate, the writing-compensation control sub-circuit 110 controls that the second node N2 is electrically disconnected from the third voltage input terminal VDD3, and thus the second node N2 does not receive the third voltage signal Vdd3.

Further under control of the gate signal Vgate, the writing-compensation control sub-circuit 110 controls that the second electrode of the driving sub-circuit 150 is electrically disconnected from the third electrode of the driving sub-circuit 150.

Furthermore, during the initiation stage T3, under control of the light-emission control signal Vem, the light-emission control sub-circuit 120 controls that the first node N1 is electrically disconnected from the second node N2, and that the second electrode of the driving sub-circuit 150 is electrically disconnected from the light-emission sub-circuit 160.

Figure 6:
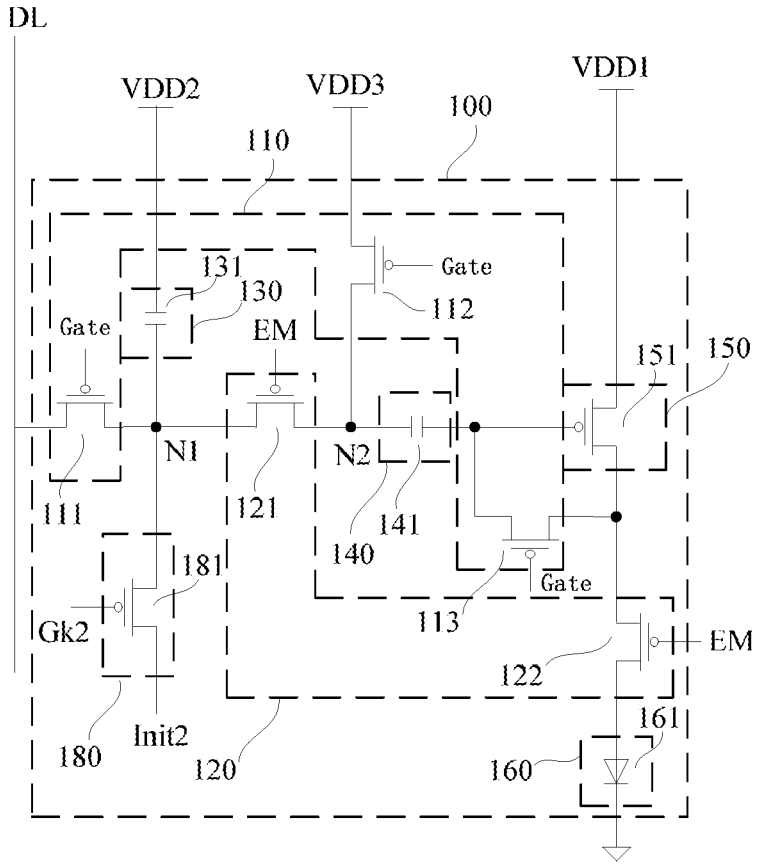
FIG. 6 illustrates a circuit diagram of a pixel driving circuit according to yet some other embodiments of the present disclosure.

FIG. 6 illustrates a circuit diagram of a pixel driving circuit according to yet some other embodiments of the present disclosure. Compared with the embodiments of the pixel driving circuit illustrated in FIG. 1, the embodiments of the pixel driving circuit illustrated in FIG. 6 further comprises a second initiating sub-circuit 180.

The second initiating sub-circuit 180 is electrically coupled with the first node N1, and is specifically between a second initiating signal line Init2 and the first node N1. Additionally, the second initiating sub-circuit 180 is electrically connected to a second initiating control signal line Gk2.

The second initiating sub-circuit 180 is configured to receive a second initiating control signal Vgk2 from the second initiating control signal line Gk2, and is further configured, under control of the second initiating control signal Vgk2, to control whether the first node N1 is electrically connected with the second initiating signal line Init2, to thereby control whether the first node N1 can receive a second initiating signal Vinit2 from the second initiating signal line Init2.

Specifically, the second initiating sub-circuit 180 comprises a second initiating transistor 181. A source electrode of the second initiating transistor 181 is electrically coupled to the second initiating signal line Init2, and is configured to receive the second initiating signal Vinit2 from the second initiating signal line Init2. A drain electrode of the second initiating transistor 181 is electrically coupled to the first node N1. A gate electrode of the second initiating transistor 181 is electrically coupled to the second initiating control signal line Gk2, and is configured to receive the second initiating control signal Vgk2 from the second initiating control signal line Gk2.

The second initiating transistor 181 is configured, under control of the second initiating control signal Vgk2, to control whether the source electrode and the drain electrode of the second initiating transistor 181 are electrically connected, in turn controlling whether the first node N1 is electrically connected with the second initiating signal line Init2, to thereby control whether the first node N1 can receive the second initiating signal Vinit2 from the second initiating signal line Init2.

Figure 7:
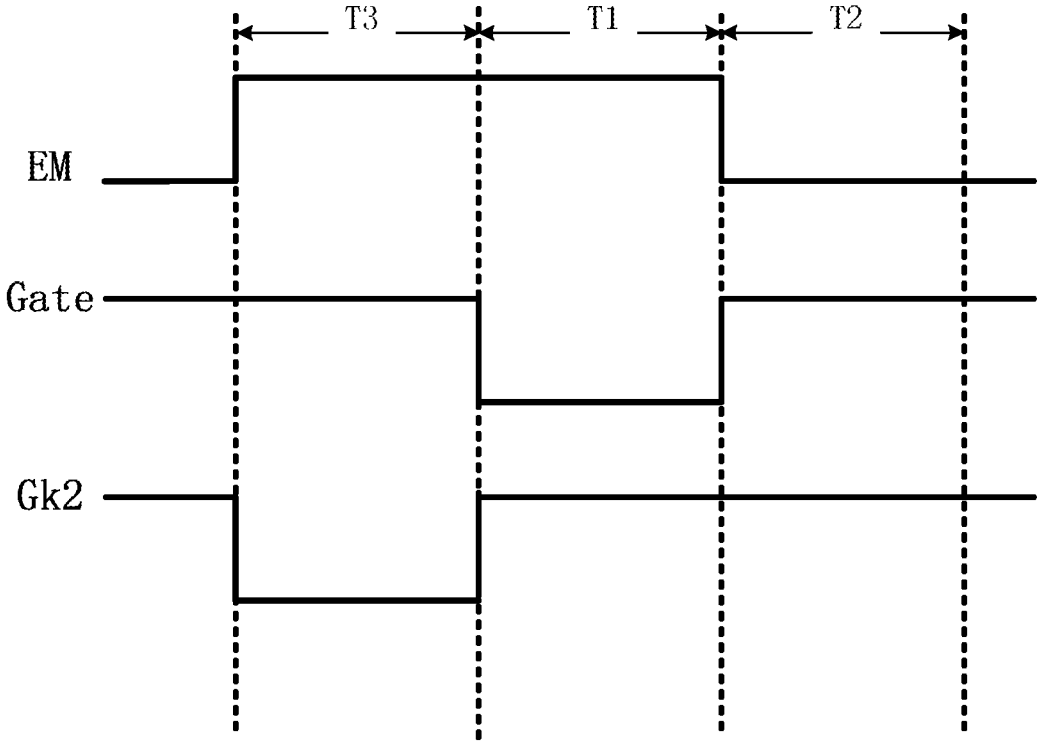
FIG. 7 illustrates a time sequence diagram of the pixel driving circuit as shown in FIG. 6.

FIG. 7 illustrates a time sequence diagram of the pixel driving circuit as shown in FIG. 6. As shown in FIG. 7, each display cycle of the pixel driving circuit as illustrated in FIG. 6 further includes an initiation stage T3 prior to the writing-compensation control stage T1.

Correspondingly, the method for driving a pixel driving circuit 100 according to the above mentioned embodiments illustrated in FIG. 6 is further provided. Specifically, during the initiation stage T3, the second initiating control signal Vgk2 from the second initiating control signal line Gk2 is a low-level signal, the light-emission control signal Vem inputted from the light-emission control signal line EM is a high-level signal, and the gate signal Vgate inputted from the gate line Gate is a high-level signal.

Under control of the second initiating control signal Vgk2, the second initiating sub-circuit 180 controls that the first node N1 is electrically connected to the second initiating signal line Init2, and further controls that the first node N1 receives the second initiating signal Vinit2 from the second initiating signal line Init2, such that the second initiating signal Vinit2 is written or inputted to the first node N1, and is further written or inputted to the first electrode of the first storage capacitor 131 to realize an initiation of the first storage capacitor 131. As such, the first electrode of the first storage capacitor 131 is set at a low level prior to the writing-compensation control stage T1 and the light-emission control stage T2, allowing an improved writing effect of the data signal Vdata.

Specifically, during the initiation stage T3, under control of the second initiating control signal Vgk2, the source electrode and the drain electrode of the second initiating transistor 181 are electrically connected, causing the first node N1 to be electrically connected to the second initiating signal line Init2. Thereby, the first node N1 can receive the second initiating signal Vinit2 from the second initiating signal line Init2 to thereby realize the initiation process.

Furthermore, during the initiation stage T3, under control of the gate signal Vgate, the writing-compensation control sub-circuit 110 controls that the first node N1 is electrically disconnected from the data line DL, and thus the first node N1 does not receive the data signal Vdata.

Additionally under control of the gate signal Vgate, the writing-compensation control sub-circuit 110 controls that the second node N2 is electrically disconnected from the third voltage input terminal VDD3, and thus the second node N2 does not receive the third voltage signal Vdd3.

Further under control of the gate signal Vgate, the writing-compensation control sub-circuit 110 controls that the second electrode of the driving sub-circuit 150 is electrically disconnected from the third electrode of the driving sub-circuit 150.

Furthermore, during the initiation stage T3, under control of the light-emission control signal Vem, the light-emission control sub-circuit 120 controls that the first node N1 is electrically disconnected from the second node N2, and that the second electrode of the driving sub-circuit 150 is electrically disconnected from the light-emission sub-circuit 160.

In the above mentioned embodiments of the pixel driving circuit as illustrated in FIG. 4 and FIG. 6, the first initiating sub-circuit 170 and the second initiating sub-circuit 180 are separately added in the pixel driving circuit 100 shown in FIG. 1, respectively. It is noted that other embodiments are possible.

Figure 8:
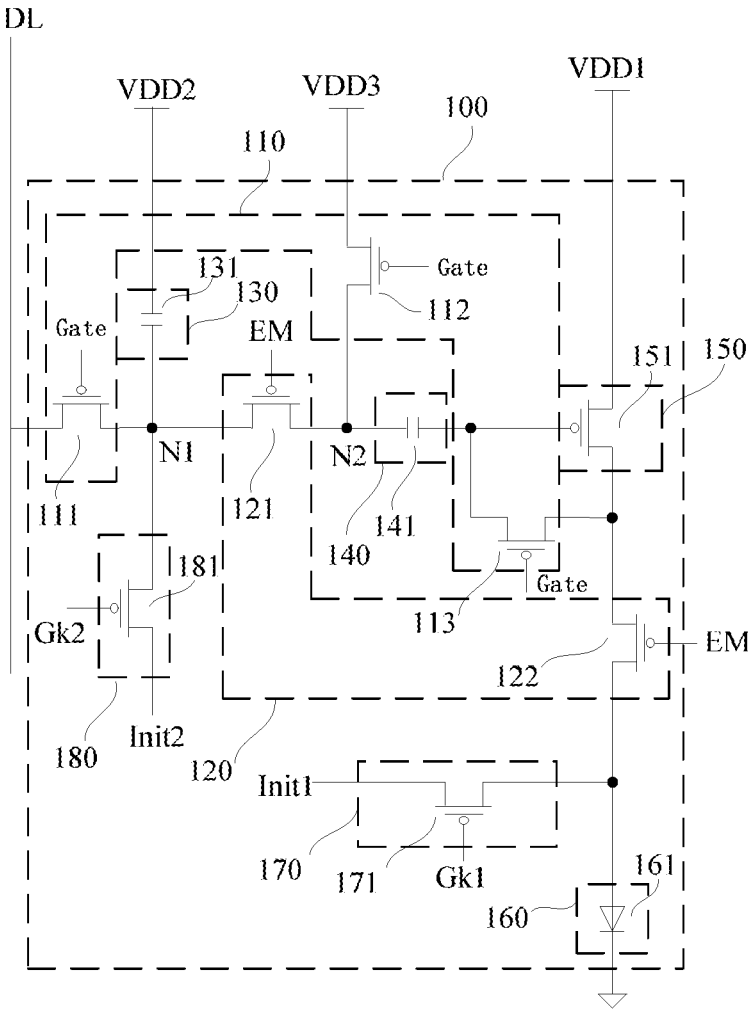
FIG. 8 illustrates a circuit diagram of a pixel driving circuit according to yet some other embodiments of the present disclosure.

For example, according to some other embodiments shown in FIG. 8, both the first initiating sub-circuit 170 and the second initiating sub-circuit 180 are added in the pixel driving circuit 100 shown in FIG. 1.

The circuit diagram and the time sequence diagram of the pixel driving circuit shown in FIG. 8 can reference to the embodiments shown in FIG. 4, FIG. 5, FIG. 6, and FIG. 7, which are skipped herein.

In a third aspect, the present disclosure further provides a display apparatus, which includes a pixel driving circuit according to any one of the embodiments as described above.

Herein the display apparatus can be a twisted nematic (TN) display apparatus, an in-plane switching (IPS) display apparatus, an advanced super-dimension switch (AD-SDS) display apparatus, an organic light-emitting diode (OLED) display apparatus, etc.

Although specific embodiments have been described above in detail, the description is merely for purposes of illustration. It should be appreciated, therefore, that many aspects described above are not intended as required or essential elements unless explicitly stated otherwise.

Various modifications of, and equivalent acts corresponding to, the disclosed aspects of the exemplary embodiments, in addition to those described above, can be made by a person of ordinary skill in the art, having the benefit of the present disclosure, without departing from the spirit and scope of the disclosure defined in the following claims, the scope of which is to be accorded the broadest interpretation so as to encompass such modifications and equivalent structures.

The invention claimed is:

1. A pixel driving circuit, comprising a writing-compensation control sub-circuit, a light-emission control sub-circuit, a first storage sub-circuit, a second storage sub-circuit, a driving sub-circuit, and a light-emission sub-circuit, wherein:

a first electrode of the driving sub-circuit is configured to receive a first voltage signal; a second electrode of the driving sub-circuit is electrically coupled to the light-emission control sub-circuit; and a third electrode of the driving sub-circuit is electrically coupled to a first electrode of the second storage sub-circuit;

a first electrode of the first storage sub-circuit is electrically coupled to a first node; a second electrode of the first storage sub-circuit is configured to receive a second voltage signal;

a second electrode of the second storage sub-circuit is electrically coupled to a second node;

the writing-compensation control sub-circuit is electrically coupled to the first node and the second node; and the writing-compensation control sub-circuit is configured to receive a data signal, a gate signal, and a third voltage signal, and is configured, under control of the gate signal, to control:

whether the first node receives the data signal;

whether the second node receives the third voltage signal; and whether the third electrode of the driving sub-circuit is electrically connected with the second electrode of the driving sub-circuit;

and the light-emission control sub-circuit is electrically coupled to the first node, the second node, a second electrode of the driving sub-circuit, and the light-emission sub-circuit; and the light-emission control sub-circuit is configured to receive a light-emission control signal, and is further configured, under control of the light-emission control signal, to control:

whether the first node is electrically connected with the second node; and whether the second electrode of the driving sub-circuit is electrically connected with the light-emission sub-circuit;

wherein:

the pixel driving circuit is configured to drive at least one display cycle;

each of the at least one display cycle comprises, prior to a writing-compensation control stage, an initiation stage, comprising: manipulating the light-emission control signal and the gate signal, such that:

the first node does not receive the data signal, the second node does not receive the third voltage signal, and the second electrode of the driving sub-circuit is electrically disconnected from the third electrode of the driving sub-circuit; and the first node is electrically disconnected from the second node, and the second electrode of the driving sub-circuit is electrically disconnected from the light-emission sub-circuit.

2. The pixel driving circuit of claim 1, wherein the driving sub-circuit comprises a P-type driving transistor, wherein a source electrode, a drain electrode, and a gate electrode of the driving transistor are respectively the first electrode, the second electrode, and the third electrode of the driving sub-circuit.

3. The pixel driving circuit of claim 1, wherein the writing-compensation control sub-circuit comprises:

a first transistor, wherein:

a source electrode thereof is configured to receive the data signal;

a drain electrode thereof is electrically coupled to the first node; and a gate electrode thereof is configured to receive the gate signal;

a second transistor, wherein:

a source electrode thereof is configured to receive the third voltage signal;

a drain electrode thereof is electrically coupled to the second node; and a gate electrode thereof is configured to receive the gate signal; and a third transistor, wherein:

a source electrode thereof is electrically coupled to the second electrode of driving sub-circuit;

a drain electrode thereof is electrically coupled to the third electrode of the driving sub-circuit; and a gate electrode thereof is configured to receive the gate signal.

4. The pixel driving circuit of claim 1, wherein the light-emission control sub-circuit comprises:

a fourth transistor, wherein:

a source electrode thereof is electrically coupled to the first node;

a drain electrode thereof is electrically coupled to the second node; and a gate electrode thereof is configured to receive the light-emission control signal;

and a fifth transistor, wherein:

a source electrode thereof is electrically coupled to the second electrode of the driving sub-circuit;

a drain electrode thereof is electrically coupled to the light-emission sub-circuit; and a gate electrode thereof is configured to receive the light-emission control signal.

5. The pixel driving circuit of claim 1, wherein the first storage sub-circuit comprises a first storage capacitor, wherein:

a first electrode thereof is electrically coupled to the first node; and a second electrode thereof is configured to receive the second voltage signal.

6. The pixel driving circuit of claim 1, wherein the second storage sub-circuit comprises a second storage capacitor, wherein:

a first electrode thereof is electrically coupled to the third electrode of the driving sub-circuit; and a second electrode thereof is electrically coupled to the second node.

7. The pixel driving circuit of claim 1, further comprising a first initiating sub-circuit, wherein:

the first initiating sub-circuit is electrically coupled with the light-emission sub-circuit, and is configured to receive a first initiating signal and a first initiating control signal; and the first initiating sub-circuit is configured, under control of the first initiating control signal, to control whether the light-emission sub-circuit receives the first initiating signal.

8. The pixel driving circuit of claim 7, wherein the first initiating sub-circuit comprises a first initiating transistor, wherein:

a source electrode thereof is configured to receive the first initiating signal;

a drain electrode thereof is electrically coupled to the light-emission sub-circuit; and a gate electrode thereof is configured to receive the first initiating control signal.

9. The pixel driving circuit of claim 1, further comprising a second initiating sub-circuit, wherein:

the second initiating sub-circuit is electrically coupled with the first node, and is configured to receive a second initiating signal and a second initiating control signal; and the second initiating sub-circuit is configured, under control of the second initiating control signal, to control whether the first node receives the second initiating signal.

10. The pixel driving circuit of claim 9, wherein the second initiating sub-circuit comprises a second initiating transistor, wherein:

a source electrode thereof is configured to receive the second initiating signal;

a drain electrode thereof is electrically coupled to the first node; and a gate electrode thereof is configured to receive the second initiating control signal.

11. The pixel driving circuit of claim 1, wherein the first voltage signal and the second voltage signal are same.

12. The pixel driving circuit of claim 11, wherein the first voltage signal and the third voltage signal are same.

13. The pixel driving circuit of claim 11, wherein the first voltage signal and the third voltage signal are different.

14. A display apparatus, comprising a pixel driving circuit according to claim 1.

15. A method for driving a pixel driving circuit, comprising at least one display cycle, wherein each of the at least one display cycle comprises:

a writing-compensation control stage, comprising: manipulating a light-emission control signal and a gate signal, such that:

a first node is electrically disconnected from a second node, and a second electrode of a driving sub-circuit is electrically disconnected from a light-emission sub-circuit; and a data signal is written to a first storage sub-circuit, the second node receives a third voltage signal; and the second electrode of the driving sub-circuit is electrically coupled with a third electrode of the driving sub-circuit;

and a light-emission control stage, comprising: manipulating the light-emission control signal and the gate signal, such that:

the first node does not receive the data signal, the second node does not receive the third voltage signal, and the second electrode of the driving sub-circuit is electrically disconnected with the third electrode of the driving sub-circuit; and the first node is electrically connected with the second node, and the second electrode of the driving sub-circuit is electrically connected with a light-emission sub-circuit to thereby allow the light-emission sub-circuit to emit lights;

wherein each of the at least one display cycle further comprises, prior to the writing-compensation control stage, an initiation stage, comprising: manipulating the light-emission control signal and the gate signal, such that:

the first node does not receive the data signal, the second node does not receive the third voltage signal, and the second electrode of the driving sub-circuit is electrically disconnected from the third electrode of the driving sub-circuit; and the first node is electrically disconnected from the second node, and the second electrode of the driving sub-circuit is electrically disconnected from the light-emission sub-circuit.

16. The method according to claim 15, wherein:

the driving sub-circuit comprises a P-type driving transistor, wherein a source electrode, a drain electrode, and a gate electrode of the driving transistor are respectively the first electrode, the second electrode, and the third electrode of the driving sub-circuit;

the pixel driving circuit further comprises:

a first transistor, wherein a source electrode thereof is configured to receive the data signal, a drain electrode thereof is electrically coupled to the first node, and a gate electrode thereof is configured to receive the gate signal;

a second transistor, wherein a source electrode thereof is configured to receive the third voltage signal, a drain electrode thereof is electrically coupled to the second node, and a gate electrode thereof is configured to receive the gate signal;

a third transistor, wherein a source electrode thereof is electrically coupled to the second electrode of the driving sub-circuit, a drain electrode thereof is electrically coupled to the third electrode of the driving sub-circuit, and a gate electrode thereof is configured to receive the gate signal;

a fourth transistor, wherein a source electrode thereof is electrically coupled to the first node, a drain electrode thereof is electrically coupled to the second node, and a gate electrode thereof is configured to receive the light-emission control signal; and a fifth transistor, wherein a source electrode thereof is electrically coupled to the second electrode of the driving sub-circuit, a drain electrode thereof is electrically coupled to the light-emission sub-circuit, and a gate electrode thereof is configured to receive the light-emission control signal;

wherein:

the manipulating the light-emission control signal and the gate signal in the writing-compensation control stage comprises: applying a turn-off signal as the light-emission control signal and applying a turn-on signal as the gate signal; and the manipulating the light-emission control signal and the gate signal in the light-emission control stage comprises: applying a turn-on signal as the light-emission control signal and applying a turn-off signal as the gate signal.

17. The method according to claim 16, wherein each of the first transistor, the second transistor, the third transistor, the fourth transistor, and the fifth transistor is a P-type transistor, wherein:

the applying a turn-off signal as the light-emission control signal and applying a turn-on signal as the gate signal comprises: applying a high-level signal as the light-emission control signal and applying a low-level signal as the gate signal; and the applying a turn-on signal as the light-emission control signal and applying a turn-off signal as the gate signal comprises: applying a low-level signal as the light-emission control signal and applying a high-level signal as the gate signal.

18. The method according to claim 15, wherein the pixel driving circuit further comprises a first initiating sub-circuit, wherein the first initiating sub-circuit is electrically coupled with the light-emission sub-circuit, and is configured to receive a first initiating signal and a first initiating control signal, and the first initiating sub-circuit is configured, under control of the first initiating control signal, to control whether the light-emission sub-circuit receives the first initiating signal, wherein the initiation stage further comprises:

manipulating the first initiating control signal such that the first initiating signal is written to the first electrode of the light-emission sub-circuit to realize an initiation of the light-emission sub-circuit.

19. The method according to claim 15, wherein the pixel driving circuit further comprises a second initiating sub-circuit, wherein the second initiating sub-circuit is electrically coupled with the first node, and is configured to receive a second initiating signal and a second initiating control signal; and the second initiating sub-circuit is configured, under control of the second initiating control signal, to control whether the first node receives the second initiating signal, wherein the initiation stage further comprises:

manipulating the second initiating control signal such that the second initiating signal is written to the first node to realize an initiation of the light-emission sub-circuit.

* * * * *